US012247803B1

(12) United States Patent
Kempf

(10) Patent No.: US 12,247,803 B1
(45) Date of Patent: Mar. 11, 2025

(54) CROSSBOW WITH INERTIA BRAKE COCKING DEVICE

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 106 days.

(21) Appl. No.: 18/137,173

(22) Filed: Apr. 20, 2023

Related U.S. Application Data

(60) Provisional application No. 63/334,760, filed on Apr. 26, 2022.

(51) Int. Cl.
*F41B 5/00* (2006.01)
*F41B 5/12* (2006.01)
*F41B 5/14* (2006.01)

(52) U.S. Cl.
CPC ..... *F41B 5/12* (2013.01); *F41B 5/1469* (2013.01); *F41B 5/1484* (2013.01)

(58) Field of Classification Search
CPC ..... F41B 5/12; F41B 5/123; F41B 5/1469; F41B 5/1484
See application file for complete search history.

(56) References Cited

U.S. PATENT DOCUMENTS 6,957,787 B1 * 10/2005 Rho ..... A01K 89/0155 188/181 A
9,494,381 B1 * 11/2016 Jeske ..... F41B 5/1469
10,948,257 B1 * 3/2021 Huang ..... F41B 5/1449
11,268,781 B1 * 3/2022 Kempf ..... F41B 5/12
11,346,632 B1 * 5/2022 Kempf ..... F41B 5/1449
2009/0277435 A1 * 11/2009 Pestrue ..... F41B 5/12 124/1
2014/0263799 A1 * 9/2014 Baerwald ..... A01K 27/004 242/381.5
2021/0348872 A1 * 11/2021 Bednar ..... F41B 5/12
2023/0228519 A1 * 7/2023 Stacy ..... F41B 5/123 124/25.6
2023/0266096 A1 * 8/2023 Bednar ..... F41B 5/12 124/25

FOREIGN PATENT DOCUMENTS

CN 210992702 * 7/2020 ..... A63B 35/00

* cited by examiner

*Primary Examiner* — John E Simms, Jr.
(74) *Attorney, Agent, or Firm* — Donald J. Ersler

(57) ABSTRACT

A crossbow with an inertia brake cocking device preferably utilizes a one-way bearing to control rotation of the drive unit used to wind (take-up) an elongated connecting device. Functional properties of an inertia brake mechanism (IBM) are well known. In its simplest form, an IBM has at least a first plate floating within a cavity, the first plate having a protrusion along an edge, and the cavity having recesses radially about its perimeter. Under controlled rotation in either direction, the IBM allows for the unrestricted rotation of the mechanism to which it is coupled. If the IBM senses a rapid acceleration of the spool, inertia moves the plate to engage a recess in the perimeter of the cavity, stopping uncontrolled rotation of the spool.

12 Claims, 9 Drawing Sheets

CROSSBOW WITH INERTIA BRAKE COCKING DEVICE

CROSS-REFERENCES TO RELATED APPLICATIONS

This is a non-provisional patent application which claims the benefit of patent application No. 63/334,760, filed on Apr. 26, 2022.

BACKGROUND OF THE INVENTION

Field of the Invention

The present invention relates generally to crossbows. A cocking mechanism which utilizes an inertia braking mechanism for ease of use. The present invention preferably uses a one way bearing to lock rotation of a cocking handle and spool. The present invention preferably utilizes an adjustable position trigger and a trigger arm retained by a stock.

Discussion of the Prior Art

Cranking devices typically use a ratchet mechanism to lock tension on a line, string or rope. More recently the use of a clutch and a one-way bearing on a direct-drive cocking mechanism was introduced on an AXE 400 crossbow. This device allowed for the silent cocking and de-cocking of a crossbow by the user, however due to this device being direct drive, it was very difficult for the user to cock the crossbow. As the stored energy increased in the limbs, it was increasingly difficult to wind the cranking mechanism. To de-cock other crossbows, it was often a hit-or-miss proposition, if the handle slipped out of the users hand, the handle would either hit the users hand causing severe injury, or just barely miss the users hand, causing damage to the crossbow. However, it appears that the prior art does not teach or suggest a cranking mechanism which utilizes an inertia breaking mechanism to prevent uncontrolled unwinding of the spool when de-cocking a crossbow or when the crank handle slips out of the user's hand.

The trigger lever on a crossbow have been historically coupled directly to the rail or barrel of the crossbow, or directly incorporated within the string latch assembly housing, eliminating the ability of adjusting the length of pull of the crossbow without altering the butt stock in some form or fashion. By pivotally retaining the trigger arm with the grip portion of the stock, and the grip portion of the stock being movable fore and aft on the rail or barrel, a desired length of pull may be easily achieved.

Accordingly, there is a clearly felt need in the art for a crossbow having cranking mechanism which utilizes an inertia braking mechanism coupled with a spool, and may be used with a one-way bearing for a controlled cocking and de-cocking of a crossbow, as well as having a crossbow with a trigger arm selectable in its location relative to length of pull. There are many advantages of these types of innovations, such as reduction in costs, ease of assembly, and less complexity.

SUMMARY OF THE INVENTION

The present invention relates to crossbows, and for the disclosure, the term "crossbow" shall include any device that is shouldered and propels an arrow. This shall include, but is not limited to, devices that are powered by limbs, springs, air, pneumatics etc, may or may not include cams, and may or may not include a bowstring. If having limbs, the limbs may face any direction, if having cams, the cams may be of any type known in the art.

The present invention provides a crossbow having a cranking mechanism which utilizes an Inertia Braking Mechanism (IBM) coupled with a drive unit to cock a crossbow. In addition, the use of a one-way bearing may control the rotation of the drive unit used to wind (take-up) an elongated connecting device. Functional properties of an IBM are well known. In its simplest form, an IBM has at least a first plate floating within a cavity, the plate having protrusion along an edge, and the cavity having recesses radially about its perimeter. Under controlled rotation in either direction, an IBM allows for the unrestricted rotation of the mechanism to which it is coupled. If the IBM senses a rapid acceleration of the spool, inertia moves the plate to engage a recess in the perimeter of the cavity, stopping uncontrolled rotation of the spool.

Functional properties of a crank mechanism for the winding and unwinding of the elongated connecting device such as a rope, chord or the like device for pulling a secondary object from a first position to a second position are well known. A preferred embodiment of the disclosure is based on the following:

A crossbow cocking device has a driven gear axially coupled to a spool, both having a first axis of rotation. A drive gear is axially coupled with a one-way bearing, both having a second axis of rotation. The one-way bearing is radially fixed in a retainer, and selectively radially retained allowing the drive gear to rotate in a first direction, winding an elongated member about the spool, but not rotate in a second direction. When the one-way bearing retainer is radially de-coupled, the one-way bearing, the retainer and the drive gear may rotate in the second direction.

The IBM is axial to the second axis of rotation, and the cavity is radially fixed. A cranking handle may be engaged with the drive gear, rotating the drive gear a first direction causing the rotation of the driven gear, winding the elongated member about the spool. The one-way bearing is selectively retained radially, and prevents the drive gear from rotating in a second direction when the crank handle ceases rotation. The user may selectively disengage the one-way bearing retainer, and rotate the crank handle in the second direction, allowing the driven gear to unwind the elongated member form the spool. Due to the functional characteristics of an IBM, a controlled rotation of the drive gear in either direction is allowed. During the unwinding of the elongated member from the spool, if the crank handle were to slip out of the user's hand, the sudden uncontrolled rotation will be sensed by the IBM, and inertia will force the plate into cooperation with the cavity, ceasing uncontrolled rotation of the spool and crank handle. Alternately, the IBM may be axial the first axis of rotation, and the cavity radially fixed. The IBM may be built into the crossbow, or removable from the crossbow. Alternately, a motor may be used to rotate the drive gear.

A second preferred embodiment replaces the one-way bearing and retainer axial with the drive shaft with a simple pawl and ratchet gear operably coupled with the drive shaft.

The trigger lever is pivotally retained with the grip portion of the crossbow stock, wherein the trigger arm is coupled to a connecting arm, which is coupled to a sear. The trigger lever may be spring loaded to a return position, to bias the trigger lever in a first or second direction. The connecting arm may be spring loaded to bias the connecting arm in a first or second direction. In a preferred embodiment, the connecting arm may be selectable for length, to change the length of pull. Alternately, the connecting arm may be of differing lengths, and the user chooses a desired length of connecting arm for the chosen length of pull. Length of pull is the distance from the shoulder-engaging portion of the butt stock and the trigger lever.

The grip portion of the crossbow having the trigger lever is coupled to the crossbow frame relative to the length of the connecting arm and length of pull.

Alternately, a trigger lever is retained in a grip portion. The trigger arm is movable from a first position to a second position, the first position does not release the bowstring, the second position releases the bowstring. A first contact surface is preferably located on the trigger lever, a second contact surface and a third contact surface are located adjacent the first contact surface. An actuator works in cooperation with the sear. When the actuator is in a first position, the sear lever is in a first position, retaining the bow string. When the actuator is in a second position, the sear is allowing the release of the bowstring. A power source is operably connected with the actuator and the second and third contact surface, in that when the trigger lever is in the first position, the first contact surface and the second and third contact surface are not interacting and an open circuit prevents actuating the actuator; when the trigger lever is in the second position, the first contact surface is in contact with the second and third contact surface and the circuit is completed activating the actuator, allowing the release of the bowstring.

The trigger lever may be spring loaded to bias the first contact surface away from the second contact surface. The grip portion of the crossbow having the trigger lever is coupled to the crossbow frame relative to the length of the desired length of pull.

Accordingly, it is an object of the present invention to provide a crossbow having a cranking mechanism which utilizes an inertia braking mechanism coupled with a spool, and may be used with a one-way bearing for a controlled cocking and de-cocking of a crossbow, as well as having a crossbow with a trigger arm selectable in its location relative to length of pull.

These and additional objects, advantages, features and benefits of the present invention will become apparent from the following specification.

DETAILED DESCRIPTION OF THE PREFERRED EMBODIMENTS

Figure 1:
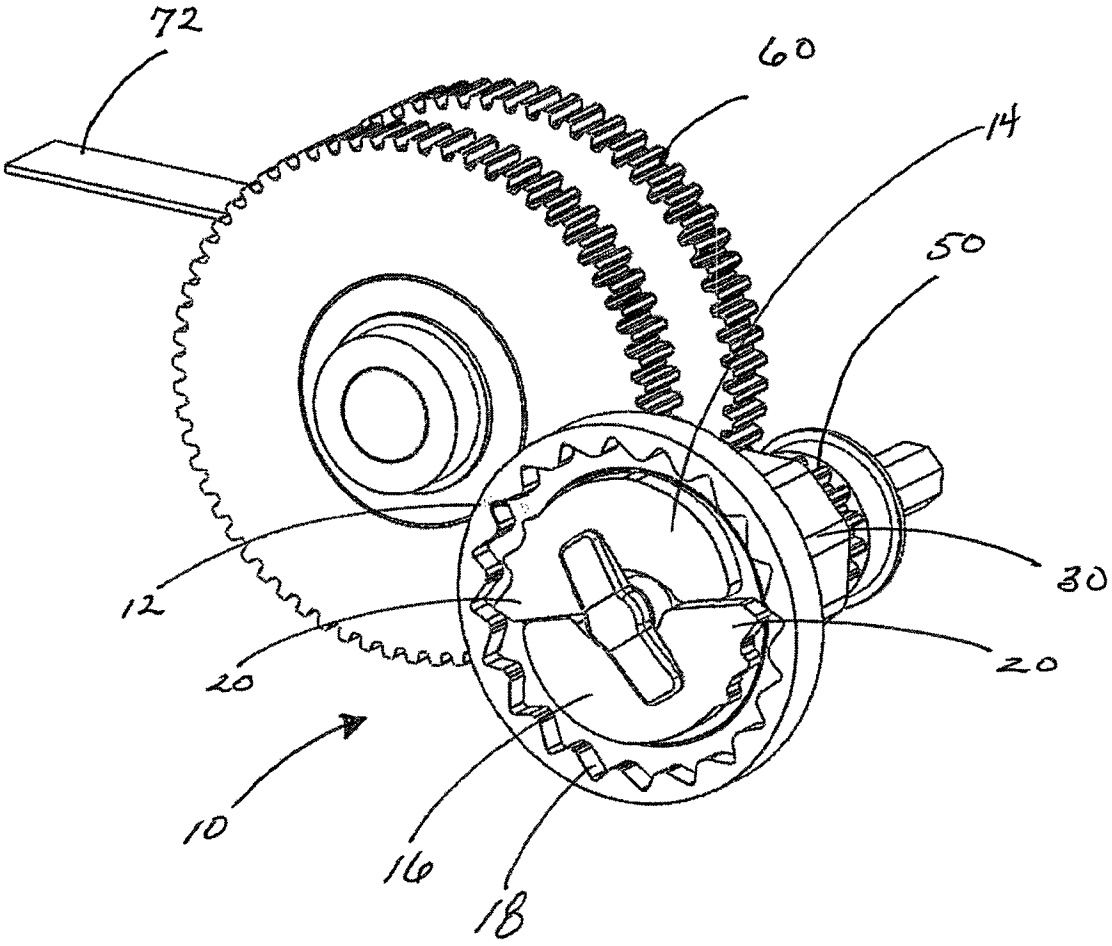
FIG. 1 is a partial rear perspective view of a cranking mechanism in accordance with the present invention.
Figure 2:
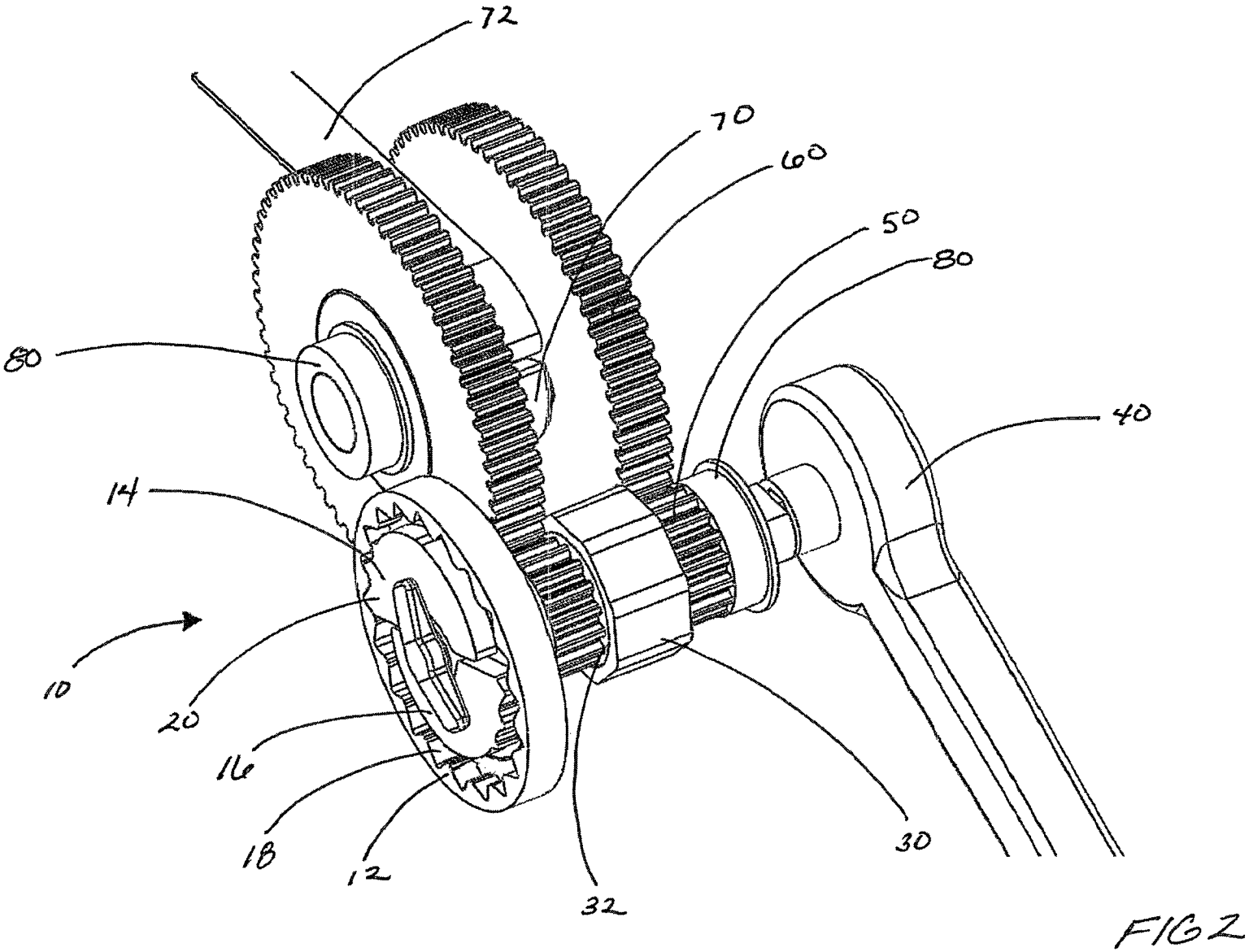
FIG. 2 is an exploded perspective view of a cranking mechanism in accordance with the present invention.
Figure 3:
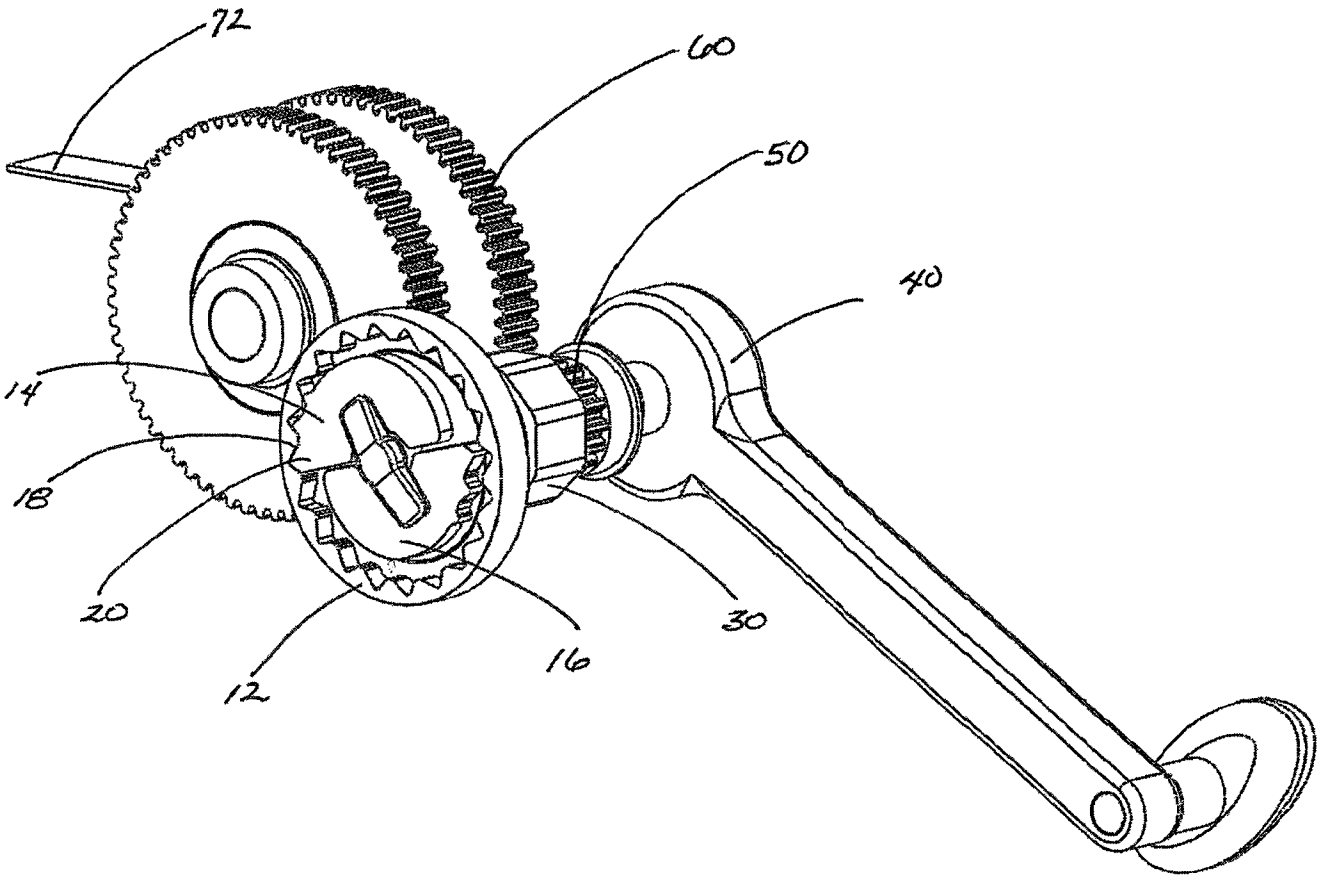
FIG. 3 is an exploded perspective view of a cranking mechanism in accordance with the present invention.
Figure 4:
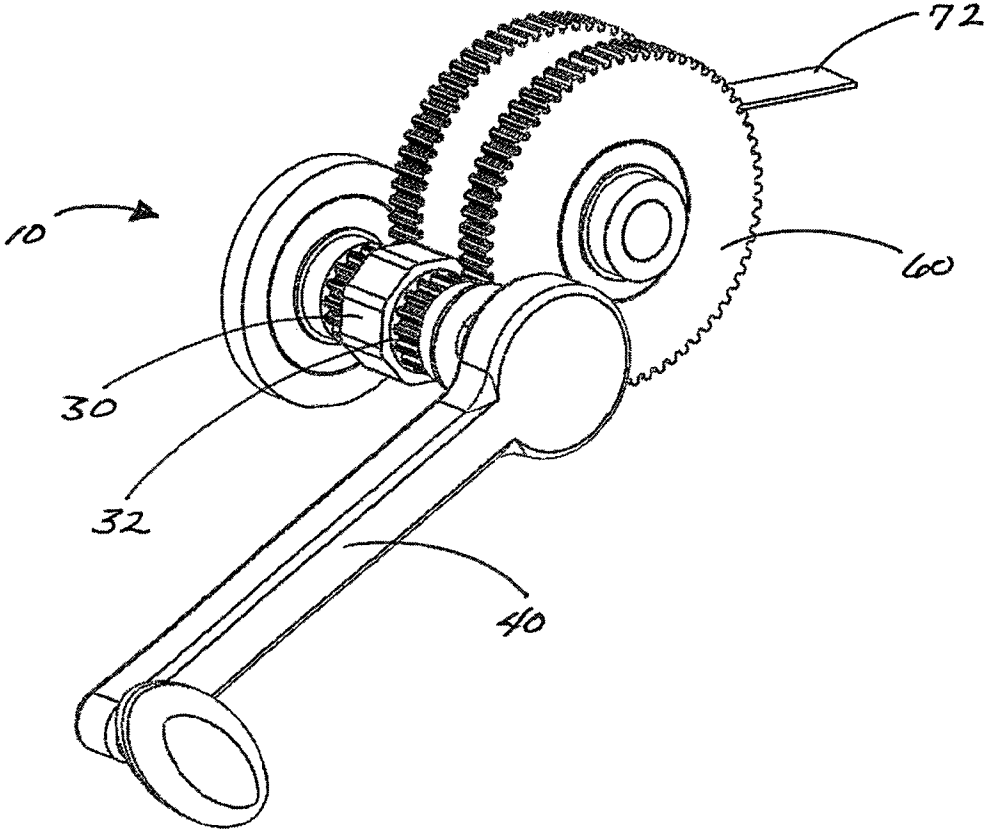
FIG. 4 is a perspective view of an assembled cranking mechanism of in accordance with the present invention.
Figure 5:
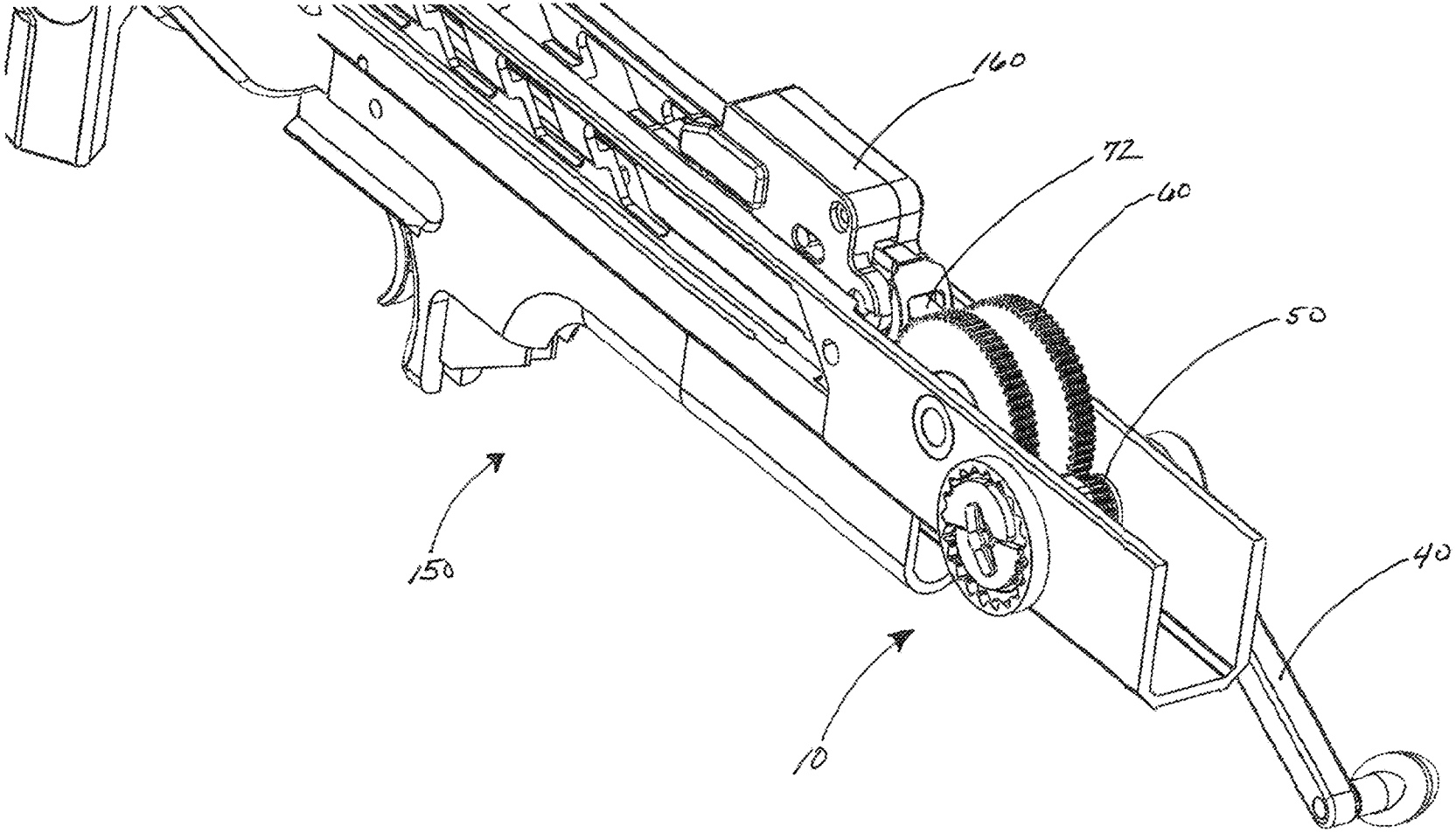
FIG. 5 is a partial perspective view of a crossbow with an integrated cranking mechanism in accordance with the present invention.
Figure 6:
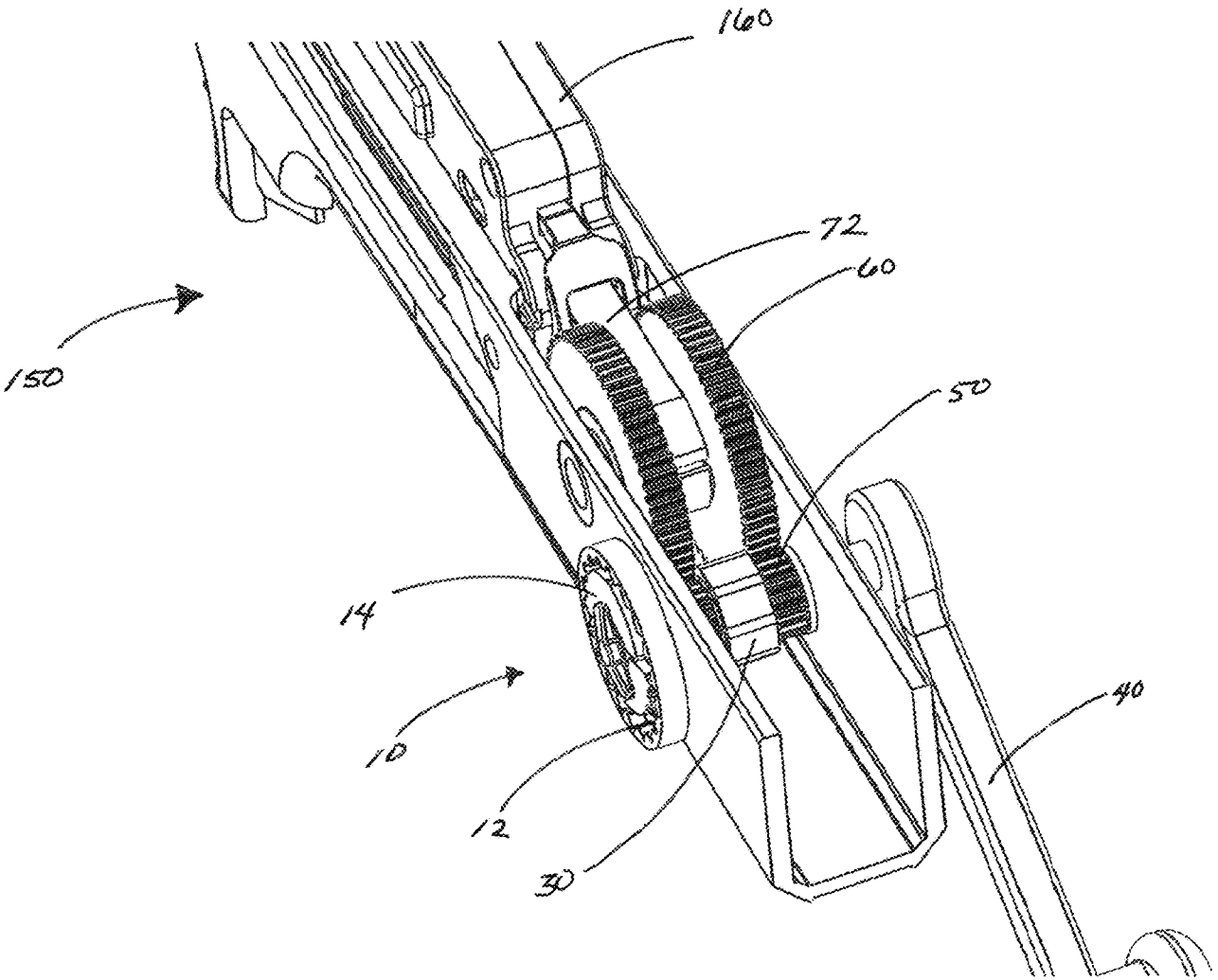
FIG. 6 is a partial perspective view of a crossbow with an integrated cranking mechanism in accordance with the present invention.
Figure 7:
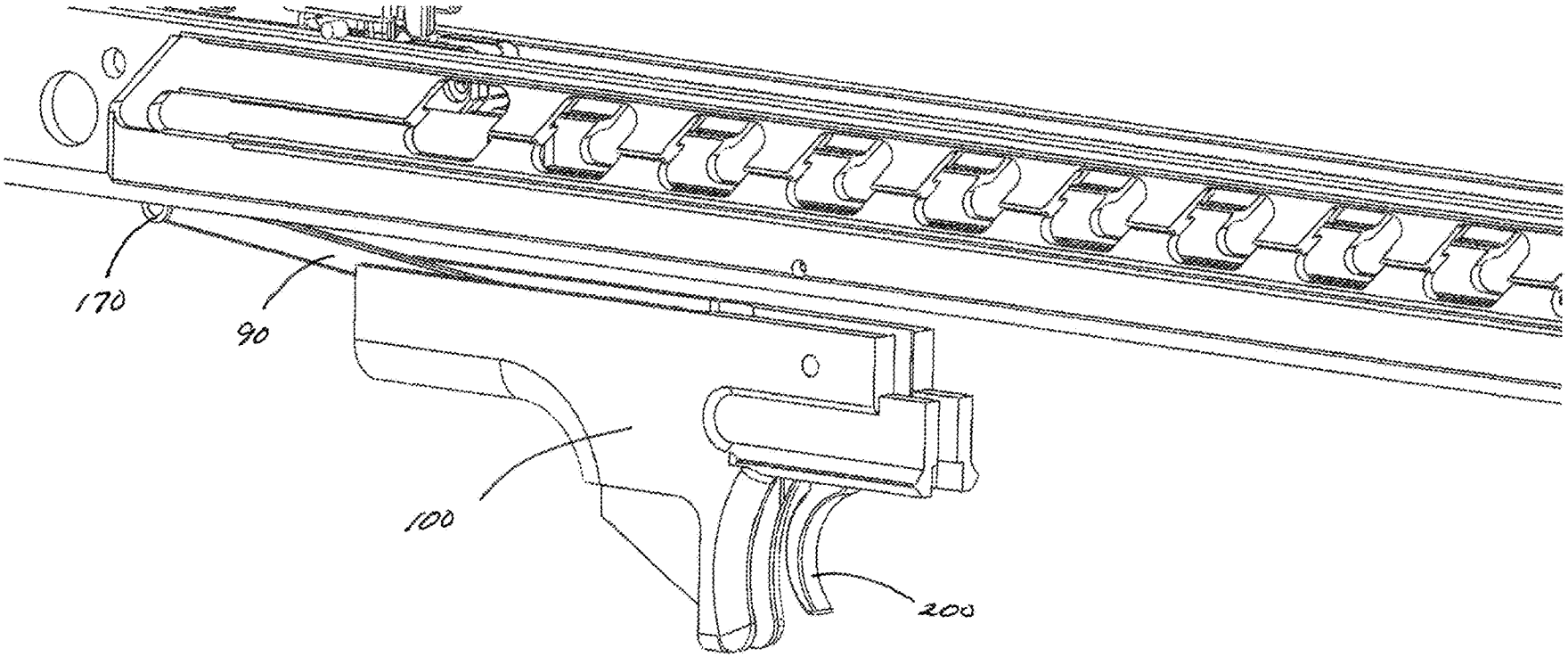
FIG. 7 is a partial perspective view of a crossbow with a grip portion and a trigger lever extending from the grip portion in accordance with the present invention.
Figure 8:
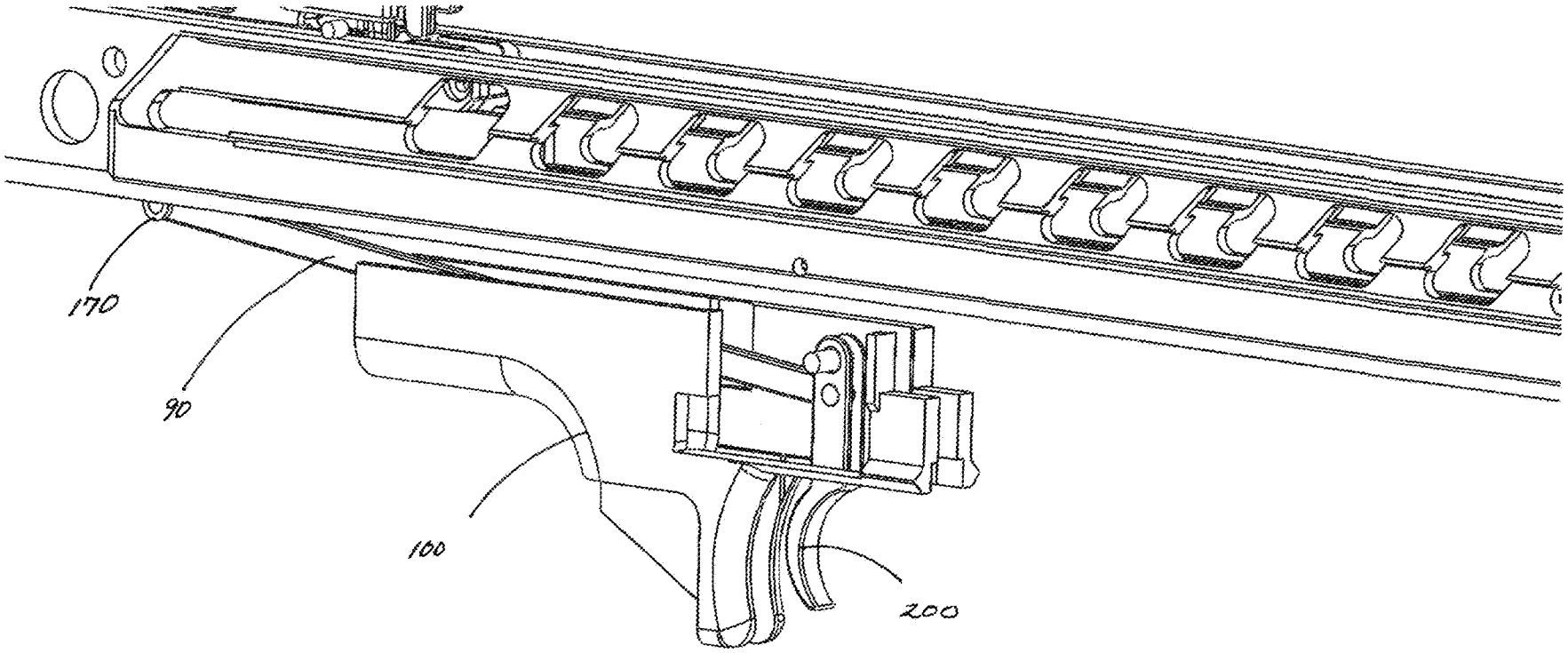
FIG. 8 is a partial perspective view of a crossbow with a portion of a grip portion removed and a trigger lever extending from the grip portion in accordance with the present invention.
Figure 9:
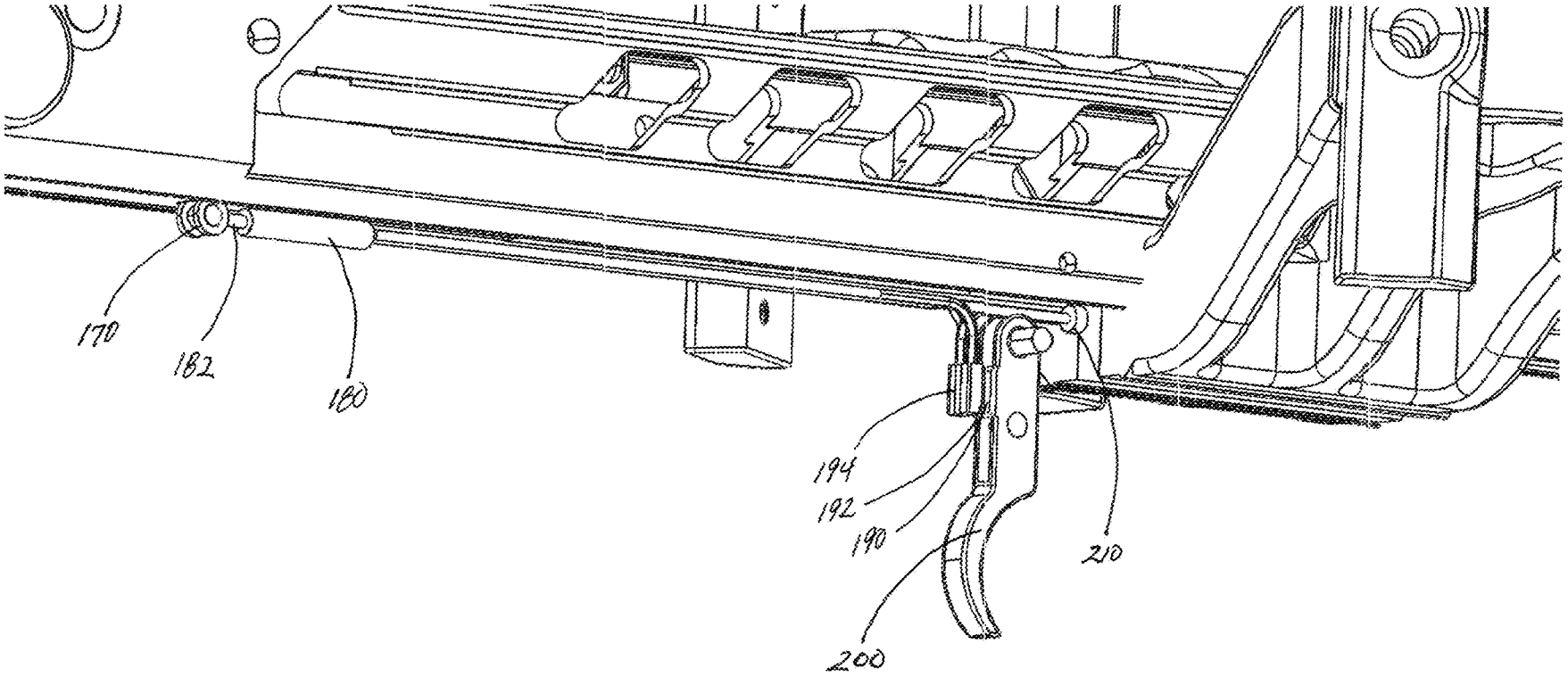
FIG. 9 is a partial perspective view of a crossbow with a grip portion removed and a trigger lever connected to an actuator in accordance with the present invention.

A crossbow cocking device has a driven gear 60 axially coupled to a spool 70, both having a first axis of rotation. A drive gear 50 is axially coupled with a one-way bearing 32, both having a second axis of rotation. The one-way bearing 32 is radially fixed in a retainer 30, and selectively radially retained allowing the drive gear 50 to rotate in a first direction winding an elongated member 72 about the spool 70, but does not rotate in a second direction. When the one-way bearing retainer 30 is radially de-coupled, the one-way bearing 32, the retainer 30 and the drive gear 50 may rotate the second direction.

The IBM 10 is axial to the second axis of rotation, and a brake ring 12 is radially fixed. A cranking handle 40 may be engaged with the drive gear 50, rotating the drive gear 50 a first direction causing the rotation of the driven gear 60, winding the elongated member 72 about the spool 70. One end of the elongated member 72 is attached to the spool 70 and an opposing end is attached to a bowstring drawing device, such as a bowstring carrier 160. The one-way bearing 32 is selectively retained radially, and prevents the drive gear 50 from rotating in a second direction when the crank handle 40 ceases rotation.

The user may selectively disengage the one-way bearing retainer 30, and rotate the crank handle 40 in the second direction, allowing the driven gear 60 to unwind the elongated member 72 from the spool 70. Due to the functional characteristics of the IBM 10, a controlled rotation of the drive gear 50 in either direction is allowed.

During the unwinding of the elongated member 72 from the spool 70, if the crank handle 40 were to slip out of the user's hand, the sudden uncontrolled rotation will be sensed by the IBM 10, and inertia will force first plate 14 and a second plate 16 into cooperation with the brake ring 12, ceasing uncontrolled rotation of the spool 70 and crank handle 40. Each brake plate 14, 16 includes a flat portion and a curved portion. The flat portion of said brake plates 14, 16 face each other. A plurality of protrusions 20 are formed on the curved portion. The plurality of protrusions 20 cooperate with a plurality of recesses 18 formed in an inside perimeter of the brake ring 12, preventing rotation of the drive gear 50 and driven gear 60. The first and second brake plates 14, 16 are slidable retained. Alternately, the IBM 10 may be axial with the first axis of rotation, and the brake ring 12 radially fixed. A peripheral space is created between the plurality of protrusions and radially spaced recesses. The IBM 10 may be built into the crossbow, or removable from the crossbow. Alternately, a motor may be used to rotate the drive gear 50.

An alternate embodiment replaces the one-way bearing 32 and retainer 30 axial with the drive shaft with a simple pawl and ratchet gear operably coupled with the drive shaft (not shown).

The trigger lever 200 is pivotally retained with the grip portion 100 of the crossbow stock, wherein the trigger lever 200 is coupled to a connecting arm 90 which is coupled to a sear. The trigger lever 200 may be spring loaded to a return position, to bias the trigger lever 200 in a first or second direction. The connecting arm 90 may be spring loaded to bias the connecting arm 90 in a first or second direction. In a preferred embodiment, the connecting arm 90 may be selectable for length, to change the length of pull. Alternately, the connecting arm 90 may be of differing lengths, and the user chooses a desired length of connecting arm 90 for the chosen length of pull. Length of pull is the distance from the shoulder-engaging portion of the butt stock and the trigger lever 200.

The grip portion 100 of the crossbow having the trigger lever 200 is coupled to the crossbow frame 150 relative to a length of the connecting arm 90 and a length of pull.

Alternately, a trigger lever 200 is retained in a grip portion 100. The trigger arm 200 is movable from a first position to a second position, the first position does not release the bowstring, the second position releases the bowstring. A first contact surface 190 is preferably located on the trigger lever 200, a second contact surface 192 and a third contact surface 194 contact surface are located adjacent the first contact surface 190. An actuator 180 works in cooperation with the sear (not shown). When the actuator 180 is in a first position, the sear lever (not shown) is in a first position, retaining the bow string. When the actuator 180 is in the second position, the sear is allowing the release of the bowstring. A power source 210 is operably connected with the actuator 180 and the second contact surface 192 and third contact surface 194, such that when the trigger lever 200 is in the first position, the first contact surface 190 does not make contact with the second contact surface 192 and the third contact surface 194. An open circuit is the result of the trigger lever 200 in the first position. When the trigger lever 200 is in the second position, the first contact surface 190 is in contact with the second and third contact surfaces 192, 194 and the circuit is completed activating the actuator 180, which allows the release of the bowstring.

The trigger lever 200 may be spring loaded to bias the first contact surface 190 away from the second contact surface 192. The grip portion 100 of the crossbow having the trigger lever 200 is coupled to the crossbow frame 150 relative to the length of the desired length of pull.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A cranking mechanism for a crossbow comprising:

a driven gear coupled to a spool and having a first axis of rotation, a drive gear having a second axis of rotation and operably coupled with said driven gear, a drive shaft includes a first driven end and a second end and is axial with said drive gear, a one way bearing is selectively fixed radially by a one way bearing retainer or selectively free to rotate radially by disengagement of said one way bearing retainer, an inertia brake mechanism radially coupled to said drive shaft, said inertia brake mechanism includes a first brake plate, a second brake plate and a brake ring, said brake ring having a plurality of radially spaced recesses, each said brake plate includes a first side, a second side, and a perimeter, said perimeter includes a flat portion and a curved portion, said flat portion of said first and second brake plates face each other, said first and second brake plates slide relative to each other within said brake ring, said curved portion includes a plurality of protrusions sized to interact with said plurality of radially spaced recesses of said brake ring, a peripheral space is created between said plurality of protrusions and radially spaced recesses; and a flexible member having a first end coupled to said spool and a second end coupled to a bowstring drawing device, said drive shaft is rotated a first direction causing rotation of said drive gear and said driven gear, winding said flexible member on said spool, said one way bearing retainer engages said one way bearing preventing rotation of said drive shaft in a second direction, said inertia brake plates rotate freely within said peripheral space.

2. The crossbow cranking mechanism of claim 1 wherein:

disengagement of said one way bearing retainer allows controlled rotation of said drive shaft in a second direction for unwinding said flexible member from said spool.

3. The crossbow cranking mechanism of claim 1 wherein:

an uncontrolled rotation of said driveshaft is interrupted by said inertia brake mechanism, in that inertia forces at least one of said plurality of protrusions to engage at least one of said plurality of radially spaced recesses.

4. A cranking mechanism for a crossbow comprising:

a driven gear coupled to a spool and having a first axis of rotation, a drive gear having a second axis of rotation and operably coupled with said driven gear, a drive shaft includes a first driven end and a second end and is axial with said drive gear, a one way bearing axial to said drive shaft and operably retaining said drive shaft, said one way bearing is selectively fixed radially by a one way bearing retainer or selectively free to rotate radially by disengagement of said one way bearing retainer, an inertia brake mechanism axial to and coupled to said driven gear, said inertia brake mechanism having a first and second brake plate and a brake ring, said brake ring having a plurality of radially spaced recesses, each of said brake plates has a first side, a second side, and a perimeter, said perimeter includes a flat portion and a curved portion, said flat portion of said first and second brake plates face each other, said first and second brake plates slide relative to each other within said brake ring, said curved portion includes a plurality of protrusions sized to interact with said plurality of radially spaced recesses of said brake ring, a peripheral space is created between said plurality of protrusions and radially spaced recesses; and a flexible member having a first end coupled to said spool and a second end coupled to a bowstring drawing, said driven end of said drive shaft is rotated in a first direction causing rotation of said drive gear and driven gear, winding said flexible member on said spool, said one way bearing retainer engages said one way bearing preventing rotation of said drive shaft a second direction, said inertia brake plates rotate freely within said peripheral space.

5. The crossbow cranking mechanism of claim 4 wherein:

disengagement of said one way bearing retainer allows controlled rotation of said drive shaft in a second direction for unwinding said flexible member from said spool.

6. The crossbow cranking mechanism of claim 4 wherein:

an uncontrolled rotation of said driveshaft is interrupted by said inertia brake mechanism, in that inertia forces at least one of said plurality of protrusions to engage at least one of said plurality of radially spaced recesses.

7. A cranking mechanism for a crossbow comprising:

a driven gear coupled to a spool and having a first axis of rotation, a drive gear having a second axis of rotation and operably coupled with said driven gear, a drive shaft includes a first driven end and a second end and is axial with said drive gear, an inertia brake mechanism axial to and coupled to driven gear, said inertia brake mechanism having first and second brake plates and a brake ring, said brake ring having a plurality of radially spaced recesses, each of said brake plates has a first side, a second side, and a perimeter, said perimeter includes a flat portion a curved portion, said flat portion of said first and second brake plates face each other, said first and second brake plates slide relative to each other within said brake ring, said curved portion includes a plurality of protrusions sized to interact with said plurality of radially spaced recesses of said brake ring, a peripheral space is created between said plurality of protrusions and radially spaced recesses; and a flexible member having a first end coupled to said spool and a second end coupled to a bowstring drawing device, said driven end of said drive shaft is rotated in a first direction causing rotation of said drive gear and a ratchet gear and said driven gear, said ratchet gear is located on said drive shaft, winding said flexible member on said spool, a pawl engages said ratchet gear preventing rotation of said drive shaft in a second direction, said inertia brake plates rotate freely within said peripheral space.

8. The crossbow cranking mechanism of claim 7 wherein:

disengagement of said pawl allows controlled rotation of said drive shaft in a second direction for unwinding said flexible member from said spool.

9. The crossbow cranking mechanism of claim 7 wherein:

an uncontrolled rotation of said driveshaft is interrupted by said inertia brake mechanism, in that inertia forces at least one of said plurality of protrusions to engage at least one of said plurality of radially spaced recesses.

10. A cranking mechanism for a crossbow comprising:

a driven gear coupled to a spool and having a first axis of rotation, a drive gear having a second axis of rotation and operably coupled with said driven gear, a drive shaft includes a first driven end and a second end and is axial with said drive gear, an inertia brake mechanism axial to and coupled to said drive gear, said inertia brake mechanism having first and second brake plates and a brake ring, said brake ring having a plurality of radially spaced recesses, each of said brake plates has a first side, a second side, and a perimeter, said perimeter includes a flat portion, said flat portion of said first and second brake plates face each other, said first and second brake plates slide relative to each other within said brake ring, said curved portion includes a plurality of protrusions sized to interact with said plurality of radially spaced recesses of said brake ring, a peripheral space is created between said plurality of protrusions and radially spaced recesses; and a flexible member having a first end coupled to said spool and a second end coupled to a bowstring drawing device, said driven end of said drive shaft is rotated a first direction causing rotation of said drive gear and a ratchet gear and said driven gear, said ratchet gear is located on said drive shaft, winding said flexible member on said spool, a pawl engages said ratchet gear preventing rotation of said drive shaft a second direction, said inertia brake plates rotate freely within said peripheral space.

11. The crossbow cranking mechanism of claim 10 wherein:

disengagement of said pawl allows controlled rotation of said drive shaft in a second direction for unwinding said flexible member from said spool.

12. The crossbow cranking mechanism of claim 10 wherein:

an uncontrolled rotation of said driveshaft is interrupted by said inertia brake mechanism, in that inertia forces at least one of said plurality of protrusions to engage at least one of said plurality of radially spaced recesses.

* * * * *